US006954118B2

(12) United States Patent
Kozyrev et al.

(10) Patent No.: US 6,954,118 B2
(45) Date of Patent: Oct. 11, 2005

(54) VOLTAGE TUNABLE COPLANAR PHASE SHIFTERS WITH A CONDUCTIVE DOME STRUCTURE

(75) Inventors: Andrey Kozyrev, St. Petersburg (RU); Louise Sengupta, Warwick, MD (US); Youngfei Zhu, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/646,018

(22) Filed: Aug. 22, 2003

(65) Prior Publication Data

US 2004/0036553 A1 Feb. 26, 2004

Related U.S. Application Data

(62) Division of application No. 09/644,019, filed on Aug. 22, 2000, now Pat. No. 6,646,522.
(60) Provisional application No. 60/150,618, filed on Aug. 24, 1999.

(51) Int. Cl.[7] ..... H01P 1/18
(52) U.S. Cl. ..... 333/161; 333/34
(58) Field of Search ..... 333/156, 161, 333/164, 34, 246

(56) References Cited

U.S. PATENT DOCUMENTS

| | | | |
|---|---|---|---|
| 5,032,805 A | 7/1991 | Elmer et al. | |
| 5,079,557 A | 1/1992 | Hopwood et al. | |
| 5,212,463 A | 5/1993 | Babbitt et al. | |
| 5,218,358 A | 6/1993 | Harrington et al. | |
| 5,307,033 A | 4/1994 | Koscica et al. | |
| 5,312,790 A | 5/1994 | Sengupta et al. | |
| 5,355,104 A | 10/1994 | Wolfson et al. | |
| 5,427,988 A | 6/1995 | Sengupta et al. | 501/137 |
| 5,451,567 A | 9/1995 | Das | |

(Continued)

FOREIGN PATENT DOCUMENTS

EP 0 608 889 A1 8/1994

OTHER PUBLICATIONS

S.S.Gevorgian et al., "*Electrically controlled HTSC/ferroelectric coplanar waveguide*" *IEE Proc.–Microw.Antennas Propag.,* Dec. 1994, pp. 501–503, vol. 141, No. 6.

R.A. Chakalov et al., "*Fabrication and investigation of* $YBa_2Cu_3O_{7-\delta}/Ba_{0.03}Sr_{0.95}TiO_3$ *thin film structures for voltage tunable devices*", *Physica C,* (1998), pp. 279–288, vol. 308, Elsevier Science B.V.

*Primary Examiner*—Benny Lee
(74) *Attorney, Agent, or Firm*—Robert P. Lenart; James S. Finn

(57) ABSTRACT

A phase shifter includes a substrate, a tunable dielectric film having a dielectric constant between 70 to 600, a tuning range of 20 to 60%, and a loss tangent between 0.008 to 0.03 at K and Ka bands positioned on a surface of the substrate, a coplanar waveguide positioned on a surface of the tunable dielectric film opposite the substrate, an input for coupling a radio frequency signal to the coplanar waveguide, an output for receiving the radio frequency signal from the coplanar waveguide, and a connection for applying a control voltage to the tunable dielectric film. A reflective termination coplanar waveguide phase shifter including a substrate, a tunable dielectric film having a dielectric constant between 70 to 600, a tuning range of 20 to 60%, and a loss tangent between 0.008 to 0.03 at K and Ka bands positioned on a surface of the substrate, first and second open ended coplanar waveguides positioned on a surface of the tunable dielectric film opposite the substrate, microstrip line for coupling a radio frequency signal to and from the first and second coplanar waveguides, and a connection for applying a control voltage to the tunable dielectric film.

10 Claims, 6 Drawing Sheets

U.S. PATENT DOCUMENTS 5,472,935 A 12/1995 Yandrofski et al.
5,479,139 A 12/1995 Koscica et al.
5,486,491 A 1/1996 Sengupta et al.
5,504,059 A 4/1996 Higaki et al.
5,557,286 A 9/1996 Varadan et al.
5,561,407 A 10/1996 Koscica et al.
5,589,845 A 12/1996 Yandrofski et al.
5,593,495 A 1/1997 Masuda et al. ..... 117/4
5,610,563 A 3/1997 Mohwinkel
5,617,103 A 4/1997 Koscica et al.
5,635,433 A 6/1997 Sengupta
5,635,434 A 6/1997 Sengupta
5,640,042 A 6/1997 Koscica et al. ..... 257/595
5,693,429 A 12/1997 Sengupta et al.
5,694,134 A 12/1997 Barnes
5,721,194 A 2/1998 Yandrofski et al.
5,766,697 A 6/1998 Sengupta et al.
5,830,591 A 11/1998 Sengupta et al.
5,846,893 A 12/1998 Sengupta et al.
5,847,620 A 12/1998 Wong et al.
5,869,429 A 2/1999 Das
5,886,867 A 3/1999 Chivukula et al. ..... 361/311
5,917,455 A 6/1999 Huynh et al.
5,940,030 A 8/1999 Hampel et al.
5,990,766 A 11/1999 Zhang et al. ..... 333/205
6,045,932 A 4/2000 Jia et al.
6,074,971 A 6/2000 Chiu et al. ..... 501/139
6,078,827 A 6/2000 Jackson
6,646,522 B1 * 11/2003 Kozyrev et al. ..... 333/161

* cited by examiner

VOLTAGE TUNABLE COPLANAR PHASE SHIFTERS WITH A CONDUCTIVE DOME STRUCTURE

CROSS REFERENCE TO RELATED PATENT APPLICATION

This application is a divisional application of U.S. patent application Ser. No. 09/644,019, filed Aug. 22, 2000, now issued as U.S. Pat. No. 6,646,522, which claims the benefit of U.S. Provisional Application Ser. No. 60/150,618, filed Aug. 24, 1999.

BACKGROUND OF INVENTION

This invention relates generally to electronic phase shifters and, more particularly to voltage tunable phase shifters for use at microwave and millimeter wave frequencies that operate at room temperature.

Tunable phase shifters using ferroelectric materials are disclosed in U.S. Pat. Nos. 5,307,033, 5,032,805, and 5,561,407. These phase shifters include a ferroelectric substrate as the phase modulating element. The permittivity of the ferroelectric substrate can be changed by varying the strength of an electric field applied to the substrate. Tuning of the permittivity of the substrate results in phase shifting when an RF signal passes through the phase shifter.

One known type of phase shifter is the microstrip line phase shifter. Examples of microstrip line phase shifters utilizing tunable dielectric materials are shown in U.S. Pat. Nos. 5,212,463; 5,451,567 and 5,479,139. These patents disclose microstrip lines loaded with a voltage tunable ferroelectric material to change the velocity of propagation of a guided electromagnetic wave.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO—MgO"; U.S. Pat. No. 5,486,491 to Sengupta, et al. entitled "Ceramic Ferroelectric Composite Material-BSTO—$ZrO_2$"; U.S. Pat. No. 5,635,434 to Sengupta, et al. entitled "Ceramic Ferroelectric Composite Material-BSTO—Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material-BSTO—ZnO". These patents are hereby incorporated by reference. A copending, commonly assigned United States patent application titled "Electronically Tunable Ceramic Materials Including Tunable Dielectric And Metal Silicate Phases", by Sengupta, filed Jun. 15, 2000, and issued Jun. 11, 2002 as U.S. Pat. No. 6,404,614 discloses additional tunable dielectric materials and is also incorporated by reference. The materials shown in these patents, especially BSTO—MgO composites, show low dielectric loss and high tunability. Tunability is defined as the fractional change in the dielectric constant with applied voltage.

Adjustable phase shifters are used in many electronic applications, such as for beam steering in phased array antennas. A phased array refers to an antenna configuration composed of a large number of elements that emit phased signals to form a radio beam. The radio signal can be electronically steered by the active manipulation of the relative phasing of the individual antenna elements. Phase shifters play a key role in operation of phased array antennas. The electronic beam steering concept applies to antennas used with both a transmitter and a receiver. Phased array antennas are advantageous in comparison to their mechanical counterparts with respect to speed, accuracy, and reliability. The replacement of gimbals in mechanically scanned antennas with electronic phase shifters in electronically scanned antennas increases the survivability of antennas used in defense systems through more rapid and accurate target identification. Complex tracking exercises can also be maneuvered rapidly and accurately with a phased array antenna system.

U.S. Pat. No. 5,617,103 discloses a ferroelectric phase shifting antenna array that utilizes ferroelectric phase shifting components. The antennas disclosed in that patent utilize a structure in which a ferroelectric phase shifter is integrated on a single substrate with plural patch antennas. Additional examples of phased array antennas that employ electronic phase shifters can be found in U.S. Pat. Nos. 5,079,557; 5,218,358; 5,557,286; 5,589,845; 5,617,103; 5,917,455; and 5,940,030.

U.S. Pat. Nos. 5,472,935 and 6,078,827 disclose coplanar waveguides in which conductors of high temperature superconducting material are mounted on a tunable dielectric material. The use of such devices requires cooling to a relatively low temperature. In addition, U.S. Pat. Nos. 5,472,935 and 6,078,827 teach the use of tunable films of $SrTiO_3$, or (Ba, Sr)$TiO_3$ with high a ratio of Sr. ST and BST have high dielectric constants, which results in low characteristics impendance. This makes it necessary to transform the low impendance phase shifters to the commonly used 50 ohm impedance.

Low cost phase shifters that can operate at room temperature could significantly improve performance and reduce the cost of phased array antennas. This could play an important role in helping to transform this advanced technology from recent military dominated applications to commercial applications.

There is a need for electrically tunable phase shifters that can operate at room temperatures and at K and Ka band frequencies (18 GHz to 27 GHz and 27 GHz to 40 GHz, respectively), while maintaining high Q factors and have characteristic impedances that are compatible with existing circuits.

SUMMARY OF THE INVENTION

Certain embodiments of this invention provide a phase shifter including a substrate, a tunable dielectric film having a dielectric constant between 70 to 600, a tuning range of 20% to 60%, and a loss tangent between 0.008 to 0.03 at K and Ka bands, the tunable dielectric film being positioned on a surface of the substrate, a coplanar waveguide positioned on a top surface of the tunable dielectric film opposite the substrate, an input for coupling a radio frequency signal to the coplanar waveguide, an output for receiving the radio frequency signal from the coplanar waveguide, and a connection for applying a control voltage to the tunable dielectric film.

The invention also encompasses a reflective termination coplanar waveguide phase shifter including a substrate, a tunable dielectric film having a dielectric constant between 70 to 600, a tuning range of 20 to 60%, and a loss tangent between 0.008 to 0.03 at K and Ka bands, the tunable dielectric film being positioned on a surface of the substrate, first and second open ended coplanar waveguide lines positioned on a surface of the tunable dielectric film opposite the substrate, a microstrip line for coupling a radio frequency signal to and from the first and second coplanar waveguide lines, and a connection for applying a control voltage to the tunable dielectric film.

The conductors forming the coplanar waveguide operate at room temperature. The coplanar phase shifters of the present invention can be used in phased array antennas at wide frequency ranges. The devices herein are unique in design and exhibit low insertion loss even at frequencies in the K and Ka bands. The devices utilize low loss tunable film dielectric elements.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS

Certain embodiments of the present invention relate generally to coplanar waveguide voltage-tuned phase shifters that operate at room temperature in the K and Ka bands. The devices utilize low loss tunable dielectric films. In the preferred embodiments, the tunable dielectric film is a Barium Strontium Titanate (BST) based composite ceramic, having a dielectric constant that can be varied by applying a DC bias voltage and can operate at room temperature.

Figure 1:
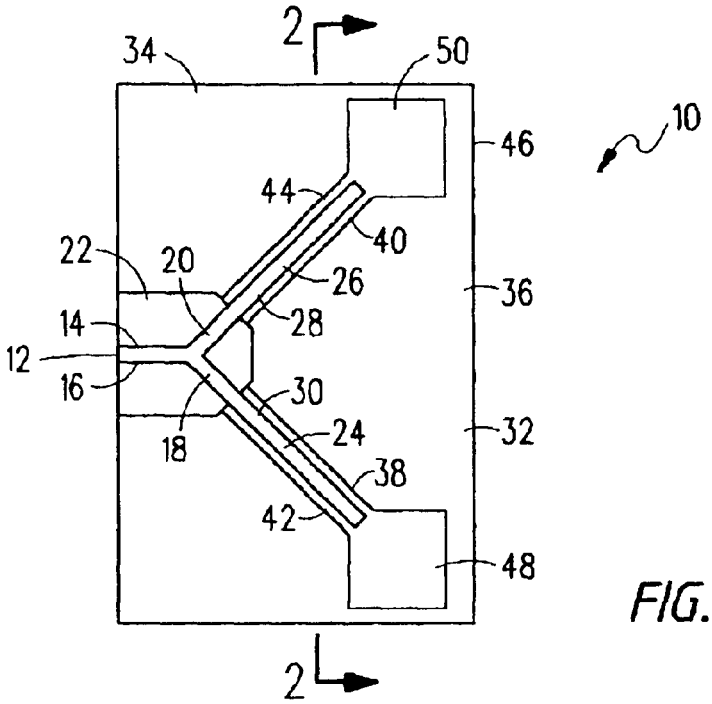
FIG. 1 is a top plan view of a reflective phase shifter constructed in accordance with the present invention.
Figure 2:
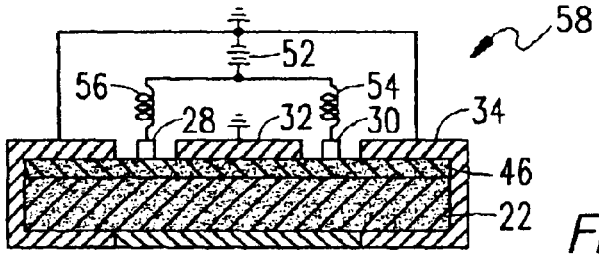
FIG. 2 is a cross-sectional view of the phase shifter of FIG. 1, taken along line 2—2.
Figure 3:
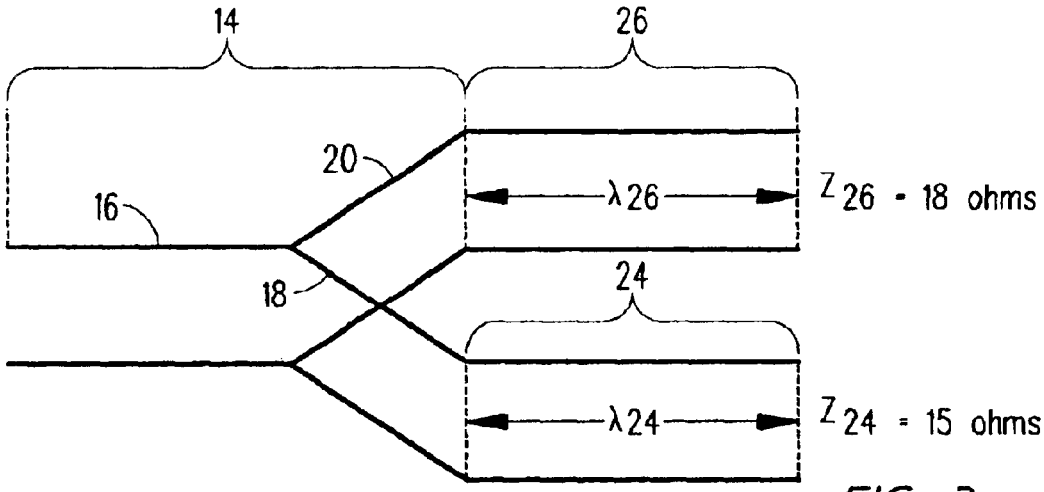
FIG. 3 is a schematic diagram of the equivalent circuit of the phase shifter of FIG. 1.

FIG. 1 is a top plan view of a reflective phase shifter constructed on a tunable dielectric layer 46 in accordance with the present invention. FIG. 2 is a cross-sectional view of the phase shifter of FIG. 1, taken along line 2—2. The embodiment of FIGS. 1 and 2 is a 20 GHz K band 360° reflective coplanar waveguide phase shifter 10 (see FIG. 1). The phase shifter 10 (see FIG. 1) has an input/output 12 (see FIG. 1) connected to a 50-ohm microstrip line 14 (see FIG. 1). The 50-ohm microstrip line 14 (see FIG. 1) includes a first linear line 16 and two quarter-wave microstrip lines 18, 20, each with a characteristic impedance of about 70 ohm. The microstrip line 14 is mounted on a substrate 22 (see FIG. 1 and FIG. 2) of material having a low dielectric constant. The two quarter-wave microstrip lines 18 (see FIG. 1), 20 (see FIG. 1 ) are transformed to coplanar waveguides (CPW) 24 (see FIG. 1) and 26 (see FIG. 1) and match the line 16 to coplanar waveguides 24 (see FIG. 1) and 26 (see FIG. 1). Each CPW includes a center strip line 28 (see FIG. 1 and FIG. 2) and 30 (see FIG. 1 and FIG. 2) respectively, and two conductors 32 (see FIG. 1 and FIG. 2) and 34 (see FIG. 1 and FIG. 2) forming a ground plane 36 (see FIG. 1) on each side of the strip lines. The ground plane conductors are separated from the adjacent strip line by gaps 38 (see FIG. 1), 40 (see FIG. 1), 42 (see FIG. 1) and 44(see FIG. 1). The coplanar waveguides 24 (see FIG. 1) and 26 (see FIG. 1) have a characteristic impedance of about Z24=15 Ohms and Z26= 18 ohms, respectively (as shown in FIG. 3). The difference in impedances is obtained by using strip line conductors having slightly different center line widths. The coplanar waveguides 24 (see FIG. 1) and 26 (see FIG. 1) work as resonators. Each coplanar waveguide is positioned on a tunable dielectric layer 46 (shown in FIG. 2). The conductors that form the ground plane are connected to each other at the edge of the assembly. The waveguides 24 (see FIG. 1) and 26 (see FIG. 1) terminate at open ends 48 (see FIG. 1) and 50 (see FIG. 1). Also shown in FIG. 2 are center strips 28 and 30 as well as two conductors 32 and 34. Further. FIG. 3 illustrates the coplanar waveguides 24 and 26 have a characteristic impedance of about Z24=15 Ohms and $Z_{26}$= 18 ohms, respectively, as well as the 50-ohm microstrip line 14 includes a first linear line 16 and two quarter-wave microstrip lines 18, 20, each with a characteristic impedance of about 70 ohm.

Impedances $Z_{24}$ and $Z_{26}$ correspond to zero bias voltage. Resonant frequencies of the coplanar waveguide resonators are slightly different and are determined by the electrical lengths of $\lambda_{24}$ and $\lambda_{26}$ (shown in FIG. 3). The slight difference in the impedances $Z_{24}$ and $Z_{26}$ is helpful in reducing phase error when the phase shifter operates over a wide bandwidth. Referring to FIG. 2, phase shifting results from dielectric constant tuning that is controlled by applying a DC control voltage 52 (also called a bias voltage) across the gaps of the coplanar waveguides 24 and 26. Inductors 54 and 56 are included in the bias circuit 58 to block radio frequency signals in the DC bias circuit.

The electrical lengths of $\lambda_{24}$ and $\lambda_{26}$ and bias voltage across the coplanar waveguide gaps determine the amount of the resulting phase shift and the operating frequency of the device. Referring to FIGS. 1 and 2, the tunable dielectric layer is mounted on a substrate 22, and the ground planes of the coplanar waveguide and the microstrip line are connected through the side edges of the substrate. A radio frequency (RF) signal that is applied to the input of the phase shifter is reflected at the open ends of the coplanar waveguide. In the preferred embodiment, the microstrip and coplanar waveguide are made of 2 micrometer thick gold with a 10 nm thick titanium adhesion layer by electron-beam evaporation and lift-off etching processing. However, other etching processes such as dry etching could be used to produce the pattern. The width of the lines depends on substrate and tunable film and is adjusted to obtain the desired characteristic impedances. The conductive strip and ground plane electrodes can also be made of silver, copper, platinum, ruthenium oxide or other conducting materials compatible to the tunable dielectric films. A buffer layer for the electrode may be necessary, depending on electrode-tunable film system and processing techniques used to construct the device.

The tunable dielectric used in the preferred embodiments of phase shifters of this invention has a lower dielectric constant than conventional tunable materials. The dielectric constant can be changed by 20% to 70% at 20 V/$\mu$m, typically about 50%. The magnitude of the bias voltage varies with the gap size, and typically ranges from about 300 to 400 V for a 20 $\mu$m gap. Lower bias voltage levels have many benefits, however, the required bias voltage is dependent on the device structure and materials. The phase shifter of FIG. 1 is designed to have 360° phase shift. The dielectric constant can range from 70 to 600, and typically from 300 to 500. In the preferred embodiment, the tunable dielectric is a barium strontium titanate (BST) based film having a dielectric constant of about 500 at zero bias voltage. The preferred material will exhibit high tuning and low loss. However, tunable material usually has higher tuning and higher loss. The preferred embodiments utilize materials with tuning of around 50%, and loss as low as possible, which is in the range of (loss tangent) 0.01 to 0.03 at 24 GHz. More specifically, in the preferred embodiment, the composition of the material is a barium strontium titanate ($Ba_xSr_{1-x}TiO_3$, BSTO, where x is less than 1), or a BSTO composite with a dielectric constant of 70 to 600, a tuning range from 20 to 60%, and a loss tangent 0.008 to 0.03 at K and Ka bands. The tunable dielectric layer may be a thin or thick film. Examples of such BSTO composites that possess the required performance parameters include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof FIG. 3 is a schematic diagram of the equivalent circuit of the phase shifter of FIGS. 1 and 2.

The K and Ka band coplanar waveguide phase shifters of the preferred embodiments of this invention are fabricated on a tunable dielectric film with a dielectric constant (permittivity) of around 300 to 500 at zero bias and a thickness of 10 micrometer. However, both thin and thick films of the tunable dielectric material can be used. The film is deposited on a low dielectric constant substrate MgO in the CPW area with thickness of 0.25 mm. For the purposes of this description a low dielectric constant is less than 25. MgO has a dielectric constant of about 10. However, the substrate can be other materials, such as $LaAlO_3$, sapphire, $Al_2O_3$ and other ceramics. The thickness of the film of tunable material can be adjusted from 1 to 15 micrometers depending on deposition methods. The main requirements for the substrates are their chemical stability, reaction with the tunable film at film firing temperature (~1200 C), as well as dielectric loss (loss tangent) at the operating frequency.

Figure 4:
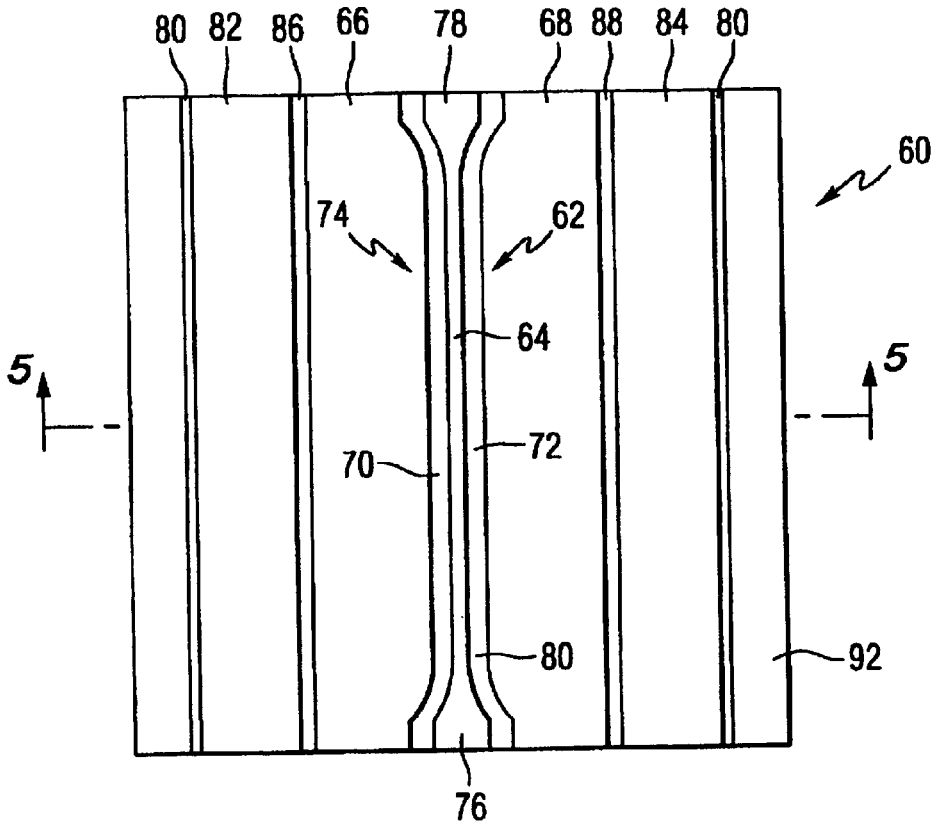
FIG. 4 is a top plan view of another phase shifter constructed in accordance with the present invention.
Figure 5:
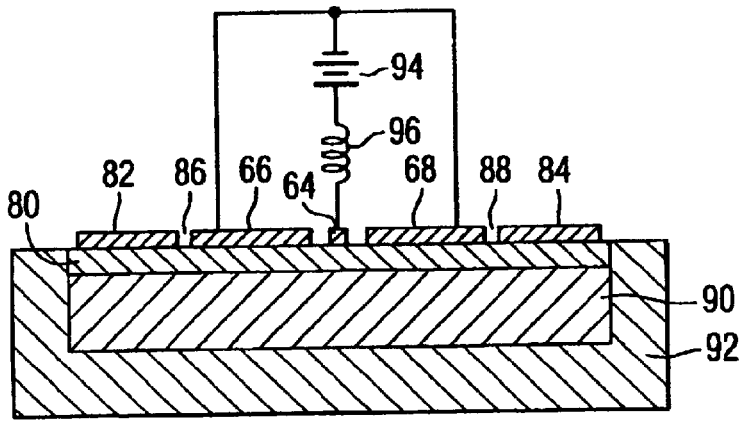
FIG. 5 is a cross-sectional view of the phase shifter of FIG. 4, taken along line 5—5.

FIG. 4 is a top plan view of a 30 GHz coplanar waveguide phase shifter assembly 60 constructed in accordance with this invention with coplanar waveguide 62 positioned on a layer of tunable dielectric material 80. FIG. 5 is a cross-sectional view of the phase shifter assembly 60 of FIG. 4, taken along line 5—5 with electrodes 66 and 68 separated from electrodes 82 and 84 respectively by gaps 86 and 88. Phase shifter assembly 60 is fabricated using a tunable dielectric film and substrate similar to those set forth above for the phase shifter of FIGS. 1 and 2. Referring to FIG. 4, assembly 60 includes a main coplanar waveguide 62 including a center line 64 and a pair of ground plane conductors 66 and 68 separated from the center line by gaps 70 and 72. The center portion 74 of the coplanar waveguide has a characteristic impedance of around 20 ohms. Two tapered matching sections 76 and 78 are positioned at the ends of the waveguide and form impedance transformers to match the 20-ohm impedance to a 50-ohm impedance. Coplanar waveguide 62 is positioned on a layer of tunable dielectric material 80. Conductive electrodes 66 and 68 are also located on the tunable dielectric layer and form the CPW ground plane. Additional ground plane electrodes 82 and 84 are also positioned on the surface of the tunable dielectric material 80. Electrodes 82 and 84 are adjacent to tunable dielectric material 80 as shown in FIG. 5. Electrodes 66 and 68 are separated from electrodes 82 and 84 respectively by gaps 86 and 88. Gaps 86 and 88 block DC voltage so that DC voltage can be biased on the CPW gaps. For dielectric constant ranging from about 200 to 400 and an MgO substrate, the center line width and gap are about 10 to 60 micrometers. Referring to FIG. 5, the tunable dielectric material 80 is positioned on a planar surface of a low dielectric constant (about 10) substrate 90, which in the preferred embodiment is MgO with thickness of 0.25 mm. However, the substrate can be other materials, such as $LaAlO_3$, sapphire, $Al_2O_3$ and other ceramic substrates. A metal holder 92 extends along the bottom and the sides of the waveguide. A bias voltage source 94 is connected to strip 64 through inductor 96.

The coplanar waveguide phase shifter 60 can be terminated with either another coplanar waveguide or a microstrip line. For the latter case, the 50-ohm coplanar waveguide is transformed to the 50-ohm microstrip line by direct connection of the central line of the coplanar waveguide to the microstrip line. The ground planes of the coplanar waveguide and the microstrip line are connected to each other through the side edges of the substrate. The phase shifting results from dielectric constant tuning by applying a DC voltage across the gaps of the coplanar waveguide.

Figure 6:
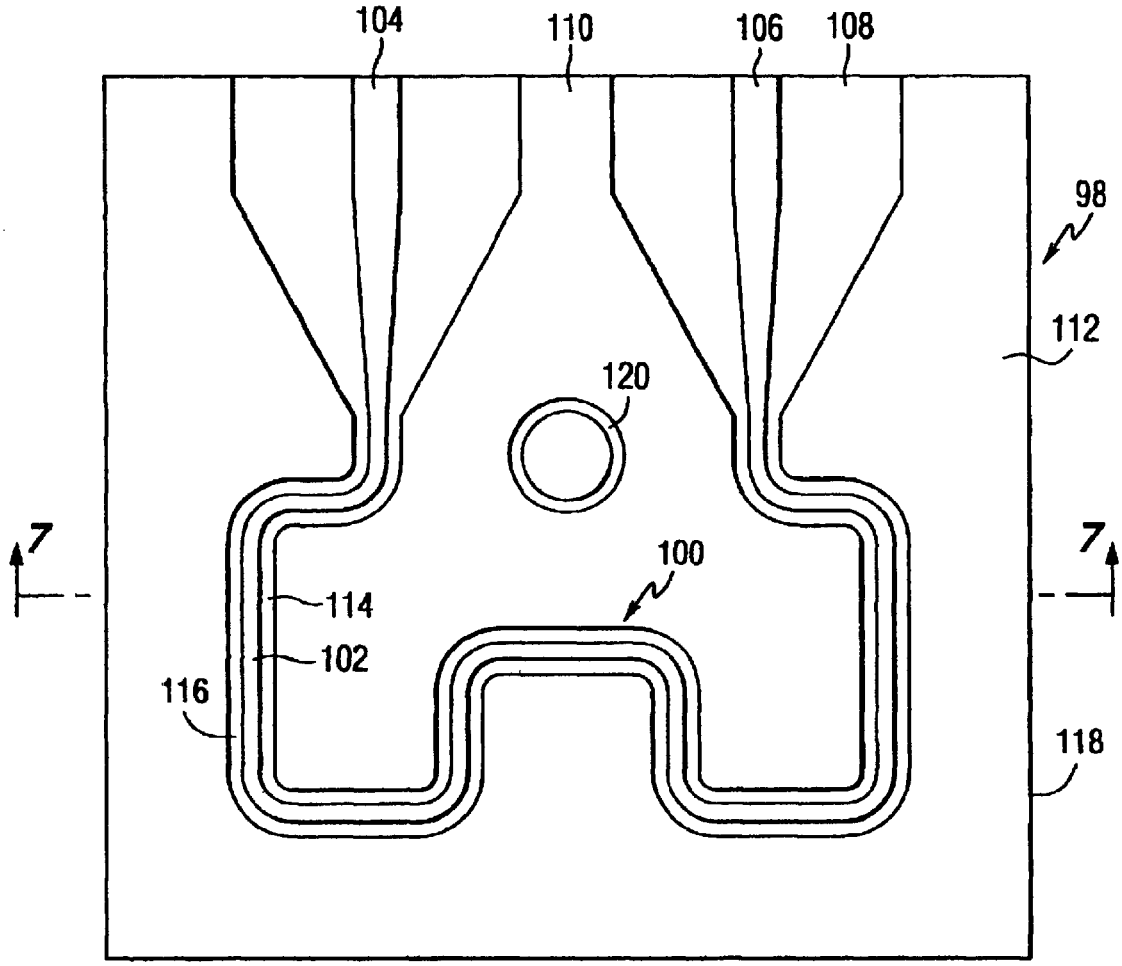
FIG. 6 is a top plan view of another phase shifter constructed in accordance with the present invention.
Figure 7:
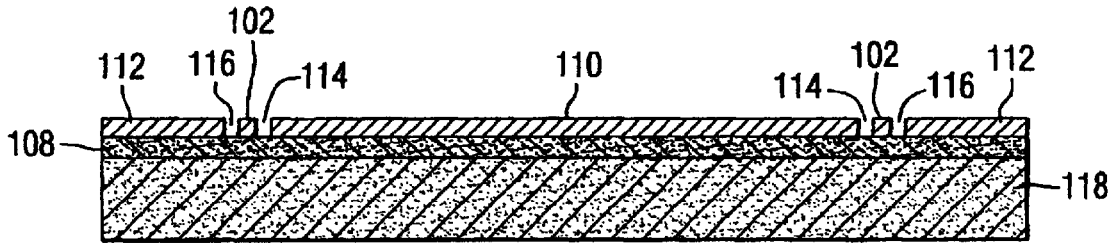
FIG. 7 is a cross-sectional view of the phase shifter of FIG. 6, taken along line 7—7.

FIG. 6 shows a 20 GHz coplanar waveguide phase shifter 98, which has a structure similar to that of FIGS. 4 and 5. However, a zigzag coplanar waveguide 100 having a central line 102 is used to reduce the size of substrate. FIG. 7 is a cross-sectional view of the phase shifter of FIG. 6, taken along line 7—7. The waveguide line 102 has an input 104 (see FIG. 6) and an output 106 (see FIG. 6), and is positioned on the surface of a tunable dielectric layer 108. A pair of ground plane electrodes 110 and 112 are also positioned on the surface of the tunable dielectric material and separated from line 102 by gaps 114 and 116. The tunable dielectric layer 108 is positioned on a low loss substrate 118 similar to that described above. The circle near the middle of the phase shifter is a via 120 (see FIG. 6) for connecting ground plane electrodes 110 and 112. The waveguide line 102 of FIG. 6 has an input 104 and an output 106, and is positioned on the surface of a tunable dielectric layer 108. Referring to FIGS. 6 and 7, a pair of ground plane electrodes 110 and 112 are also positioned on the surface of the tunable dielectric material and separated from line 102 by gaps 114 and 116. The tunable dielectric layer 108 is positioned on a low loss substrate 118 similar to that described above. The circle near the middle of the phase shifter is a via 120 for connecting ground plane electrodes 110 and 112 as shown in FIG. 6.

Figure 8:
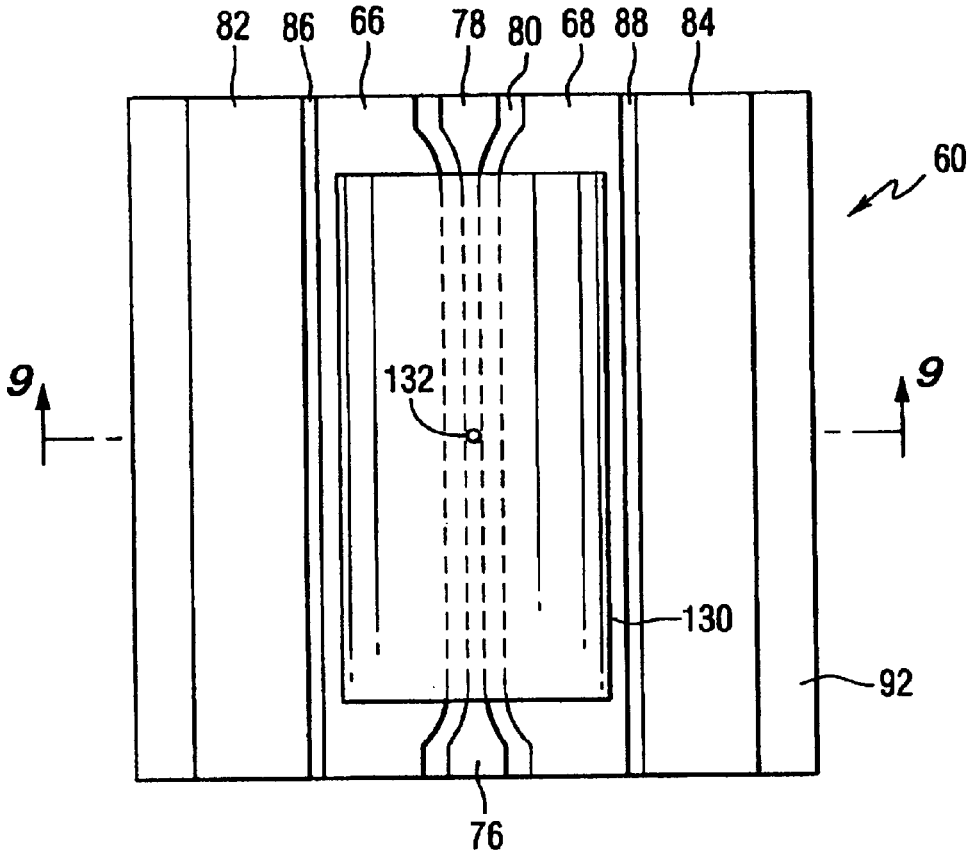
FIG. 8 is a top plan view of another phase shifter constructed in accordance with the present invention.
Figure 9:
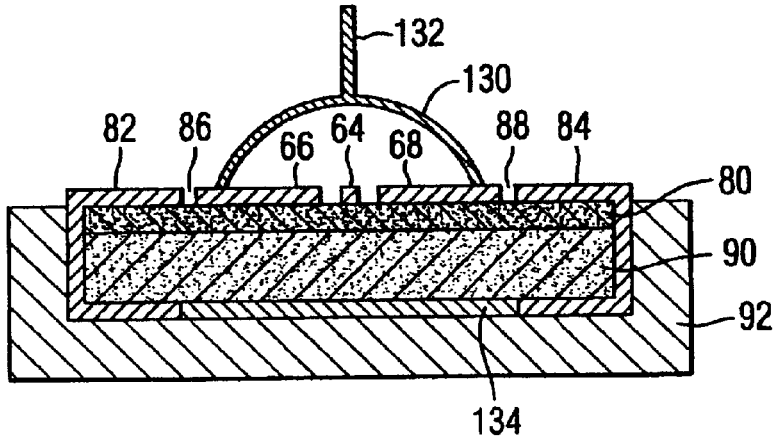
FIG. 9 is a cross-sectional view of the phase shifter of FIG. 8, taken along line 9—9.

FIG. 8 is a top plan view of the phase shifter assembly 42 of FIG. 4 with a bias dome 130 of FIG. 9 added to connect the bias voltage to ground plane electrodes 66 and 68. As seen in FIG. 8, a 30 GHz coplanar waveguide phase shifter assembly 60 is constructed in accordance with this invention. Two tapered matching sections 76 and 78 are positioned at the ends of the waveguide and form impedance transformers to match the 20-ohm impedance to a 50-ohm impedance. Coplanar waveguide 60 is positioned on a layer of tunable dielectric material 80. FIG. 8 further illustrates an electrode termination 132 (also depicted in FIG. 9). FIG. 9 is a cross-sectional view of the phase shifter assembly 60 of FIG. 8, taken along line 9—9 illustrating coplanar waveguide 60 positioned on a layer of tunable dielectric material 80. The tunable dielectric material 80 is positioned on a planar surface of a low dielectric constant (about 10) substrate 90. A metal holder 92 extends along the bottom and the sides of the waveguide. Referring to FIG. 8, the dome 130 of FIG. 9 connects the two ground planes of the coplanar waveguide, and covers the main waveguide line. An electrode termination 132 of FIG. 9 is soldered on the top of the dome 130 to connect to the DC bias voltage control. Another termination (not shown) of the DC bias control circuit is connected to the central line 64 of the coplanar waveguide. In order to apply the bias DC voltage to the CPW, small gaps 86 and 88 (shown in FIG. 8 as a top plan view and FIG. 9 as a cross section view) are made to separate the inside ground plane electrodes 66 and 68, where the DC bias dome 130 is located, to the other part (outside) of the ground plane (electrodes 82 and 84, shown in FIG. 8 as a top plan view and FIG. 9 as a cross section view) of the coplanar waveguide. The outside ground plane extends around the sides and bottom plane of the substrate. Referring to FIG. 9, the outside or the bottom ground plane is connected to an RF signal ground plane 134. The positive and negative electrodes of the DC source are connected to the dome 130 and the center line 64, respectively. The small gaps in the ground plane work as DC blocking capacitors, which block DC voltage. However, the capacitance should be high enough to allow passage of an RF signal through it. The dome 130 electrically connects ground planes 66 and 68. The dome 130 connection should be mechanically strong enough to avoid touching other components. It should be noted that the widths of ground planes 66 and 68 are about 0.5 mm in this example.

Figure 10:
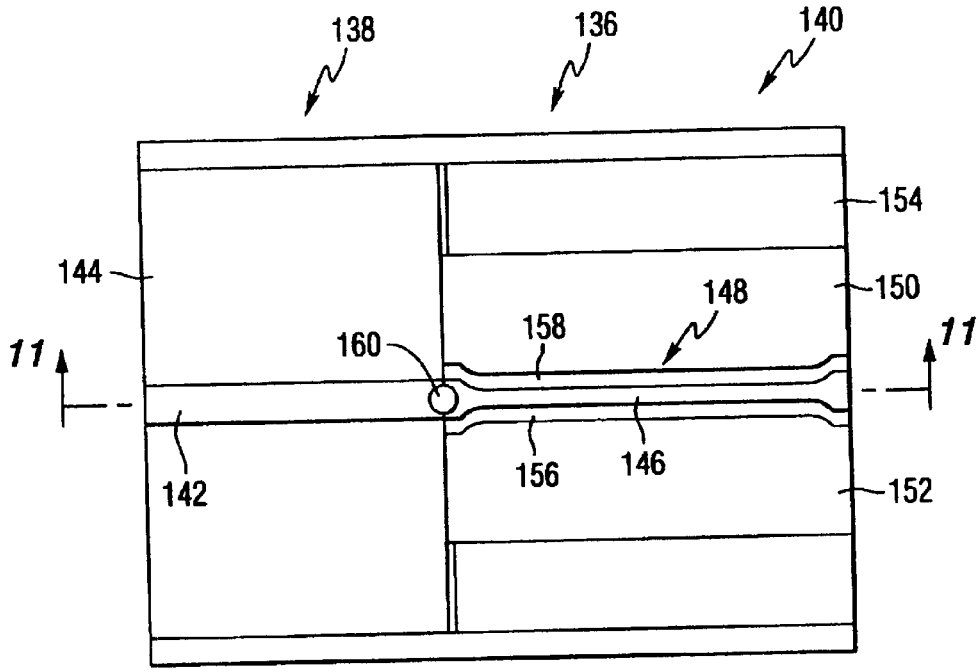
FIG. 10 is a top plan view of another phase shifter constructed in accordance with the present invention.
Figure 11:
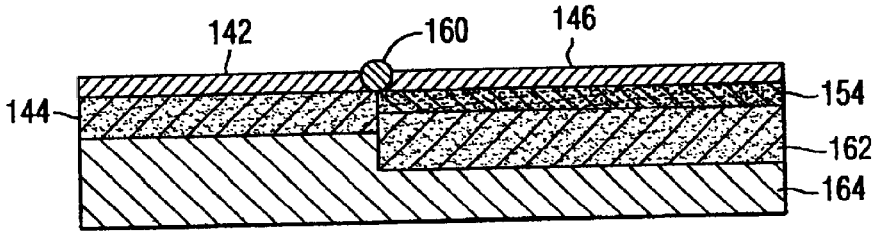
FIG. 11 is a cross-sectional view of the phase shifter of FIG. 10, taken along line 11—11.

A microstrip line and the coplanar waveguide line can be connected to one transmission line. FIG. 10 is a top plan view of another phase shifter 136 constructed in accordance with the present invention. FIG. 11 is a cross-section view of the phase shifter of FIG. 10, taken along line 11—11. FIGS. 10 and 11 shows how the microstrip 138 line transforms to the coplanar waveguide assembly 140. Referring to FIG. 10, the microstrip 138 includes a conductor 142 (top plan view in FIG. 10 and cross section view in FIG. 11) mounted on a substrate 144 (top plan view in FIG. 10 and cross section view in FIG. 11). The conductor 142 (top plan view in FIG. 10 and cross section view in FIG. 11) is connected, for example by soldering or bonding, to a central conductor 146 (top plan view in FIG. 10 and cross section view in FIG. 11) of coplanar waveguide 148 (top plan view in FIG. 10). Ground plane conductors 150 (FIG. 10) and 152 (FIG. 10) are mounted on a tunable dielectric material 154 (top plan view in FIG. 10 and cross section view in FIG. 11) and separated from conductor 146 (top plan view in FIG. 10 and cross section view in FIG. 11) by gaps 156 and 158 of FIG. 10. In the illustrated embodiment, solder 160 (top plan view in FIG. 10 and cross section view in FIG. 11) connects conductors 142 and 146 (top plan view in FIG. 10 and cross section view in FIG. 11). Referring to FIG. 11, the tunable dielectric material 154 is mounted on a surface of a non-tunable dielectric substrate 162. Substrates 144 and 162 (top plan view in FIG. 10 and cross section view in FIG. 11, respectively) are supported by a metal holder 164 (FIG. 11).

Since the gaps in the coplanar waveguides (<0.04 mm) are much smaller than the thickness of the substrate (0.25 mm), almost all RF signals are transmitted through the coplanar waveguide rather than the microstrip line. This structure makes it very easy to transform from the coplanar waveguide to a microstrip line without the necessity of a via or coupling transformation.

Figure 12:
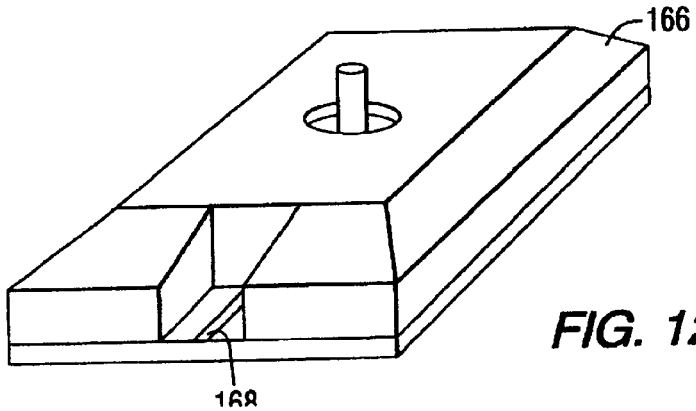
FIG. 12 is an isometric view of a phase shifter constructed in accordance with the present invention.

FIG. 12 is an isometric view of a phase shifter constructed in accordance with the present invention. A housing 166 is built over the bias dome to cover the whole phase shifter such that only two 50 ohm microstrip lines are exposed to connect to an external circuit. Only line 168 is shown in this view.

Figure 13:
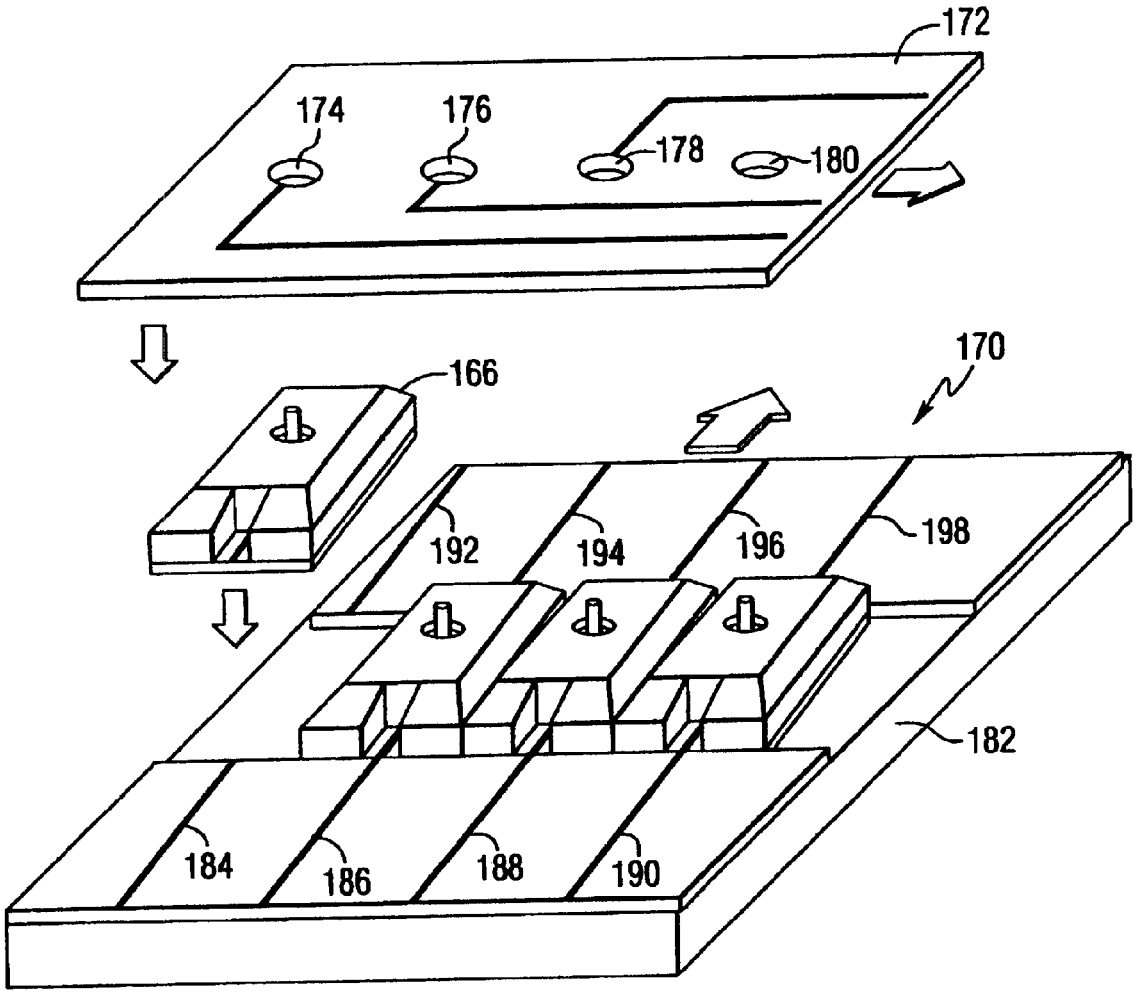
FIG. 13 is an exploded isometric view of an array of phase shifters constructed in accordance with the present invention.

FIG. 13 is an exploded isometric view of an array 170 of 30 GHz coplanar waveguide phase shifters constructed in accordance with the present invention, for use in a phased array antenna. A bias line plate 172 is used to cover the phase shifter array. The electrodes on the dome of each phase shifter are soldered to the bias lines on the bias line plate through the holes 174, 176, 178 and 180. The phase shifters are mounted in a holder 182 that includes a plurality of microstrip lines 184, 186, 188, 190, 192, 194, 196 and 198 for connecting the radio frequency input and output signals to the phase shifters. The particular structures shown in FIG. 13, provide each phase shifter with its own protective housing. The phase shifters are assembled and tested individually before being installed in the phased array antenna. This significantly improves yield of the antenna, which usually has tens to thousands phase shifters. Again, a housing 166 is built over the bais dome to cover the whole phase shifter such that only two 50 ohm microstrip lines are exposed to connect to an external circuit.

The coplanar phase shifters of the preferred embodiments of this invention are fabricated on the voltage-tuned Barium Strontium Titanate (BST) based composite films. The BST composite films have excellent low dielectric loss and reasonable tunability. These K and Ka band coplanar waveguide phase shifters provide the advantages of high power handling, low insertion loss, fast tuning, loss cost, and high anti-radiation properties compared to semiconductor based phase shifters. It is very common that dielectric loss of materials increases with frequency. Conventional tunable materials are very lossy, especially at K and Ka bands. Coplanar phase shifters made from conventional tunable materials are extremely lossy, and useless for phased array antennas at K and Ka bands. It should be noted that the phase shifter structures of the present invention are suitable for any tunable materials. However, only low loss tunable materials can achieve good, useful phase shifters. It is desirable to use low dielectric constant material for microstrip line phase shifter, since high dielectric constant materials easily generate high EM modes at these frequency ranges for microstrip line phase shifters. However, no such low dielectric constant conventional materials (<100) are available.

The preferred embodiments of the present invention provide coplanar waveguide phase shifters, which include a BST-based composite thick film having a tunable permittivity. These coplanar waveguide phase shifters do not employ bulk ceramic materials as in the microstrip ferroelectric phase shifters above. The bias voltage of the coplanar waveguide phase shifter on film is lower than that of the microstrip phase shifter on bulk material. The thick film tunable dielectric layer can be deposited by standard thick, film process onto low dielectric loss and high chemical stability subtracts, such as MgO, $LaAlO_3$, sapphire, $Al_2O_3$, and a variety of ceramic substrates.

This invention encompasses reflective coplanar waveguide phase shifters as well as transmission coplanar waveguide phase shifters. Reflective coplanar waveguide phase shifters constructed in accordance with the invention can operate at 20 GHz. Transmission coplanar waveguide phase shifters constructed in accordance with the invention can operate at 20 GHz and 30 GHz. Both types of phase shifters can be fabricated using the same substrate with a tunable dielectric film on the low dielectric loss substrate. A ground plane DC bias and DC block are used. The bias configuration is easy to manufacture, and is not sensitive to small dimensional variations. The phase shifters can have ports with either coplanar waveguide or microstrip lines. For microstrip ports, a direct transformation of the coplanar waveguide to a microstrip is possible. The bandwidth of phase shifters in the present invention is determined by matching sections (impedance transformer sections). The use of more matching sections or longer tapered matching sections permits operation over a wider bandwidth. However, it results in more insertion loss of the phase shifters.

The preferred embodiment of the present invention uses composite materials, which include BST and other materials, and two or more phases. These composites show much lower dielectric loss, and reasonable tuning, compared to conventional ST or BST films. These composites have much lower dielectric constants than conventional ST or BST films. The low dielectric constants permit easy design and manufacture of the phase shifters. Phase shifters constructed in accordance with this invention can operate at room temperature (~300° K.). Room temperature operation is much easier, and much less costly than prior art phase shifters that operate at 100° K.

The phase shifters of the present invention also include a unique DC bias arrangement that uses a long gap in the ground plane as a DC block. They also permit a simple method for transforming the coplanar waveguide to a microstrip line.

While the invention has been described in terms of what are at present its preferred embodiments, it will be apparent to those skilled in the art that various changes can be made to the preferred embodiments without departing from the scope of the invention, which is defined by the claims.

What is claimed is:

1. A phase shifter comprising:

a substrate;

a tunable dielectric film having a dielectric constant between 70 to 600, a tuning range of 20 to 60%, and a loss tangent between 0.008 to 0.03 at K and Ka bands, the tunable dielectric film being positioned on a surface of the substrate;

a coplanar waveguide positioned on a surface of the tunable dielectric film opposite the substrate;

an input for coupling a radio frequency signal to the conductive strip;

an output for receiving the radio frequency signal from the conductive strip;

a connection for applying a control voltage to the tunable dielectric film, wherein the coplanar waveguide comprises:

a first electrode position adjacent a first side of said conductive strip to provide a first gap between the first electrode and the conductive strip; and a second electrode position adjacent a second side of said conductive strip to provide a second gap between the second electrode and the conductive strip; and a conductive dome electrically connected between the first and second electrodes.

2. The phase shifter according to claim 1, wherein the high dielectric constant voltage tunable dielectric film comprises a barium strontium titanate composite.

3. The phase shifter according to claim 1, further comprising:

a first impedance matching section of said coplanar waveguide coupled to said input; and a second impedance matching section of said coplanar waveguide coupled to said output.

4. The phase shifter according to claim 3, wherein the first impedance matching section comprises a first tapered coplanar waveguide section; and wherein the second impedance matching section comprises a second tapered coplanar waveguide section.

5. The phase shifter according to claim 1, further comprising:

a third electrode position adjacent a first side of said first electrode opposite said conductive strip to provide a third gap between the first electrode and the third electrode; and a fourth electrode position adjacent a first side of said second electrode opposite said conductive strip to provide a fourth gap between the second electrode and the fourth electrode.

6. The phase shifter according to claim 1, wherein the substrate comprises one of:

MgO, $LaAlO_3$, sapphire, $Al2O_3$, and a ceramic.

7. The phase shifter according to claim 1, wherein the substrate has a dielectric constant of less than 25.

8. The phase shifter according to claim 1, wherein the tunable dielectric film has a dielectric constant of greater than 300.

9. The phase shifter according to claim 1, further comprising:

a conductive housing covering the phase shifter.

10. The phase shifter according to claim 1, wherein the tunable dielectric is selected from the group consisting of:

barium strontium titanate ($BaxSr_{1-x}TiO_3$, BSTO, where x is less than 1), BSTO—MgO, BSTO—$MgAl_2O_4$, BSTO—$CaTiO_3$, BSTO—$MgTiO_3$, and BSTO—$MgSrZrTiO_6$.

* * * * *